United States Patent [19]

Artzt et al.

[11] Patent Number: 4,825,633

[45] Date of Patent: May 2, 1989

[54] PROCESS AND DEVICE FOR THE SPINNING OF FIBERS

[75] Inventors: Peter Artzt, Reutlingen; Kurt Ziegler, Kircheim-Nabern; Harald Dallmann; Gerhard Egbers, both of Reutlingen, all of Fed. Rep. of Germany

[73] Assignee: Schubert & Salzer, Ingolstadt, Fed. Rep. of Germany

[21] Appl. No.: 82,635

[22] PCT Filed: Sep. 2, 1986

[86] PCT No.: PCT/DE86/00350

§ 371 Date: Sep. 3, 1987

§ 102(e) Date: Sep. 3, 1987

[87] PCT Pub. No.: WO87/03308

PCT Pub. Date: Jun. 4, 1987

[30] Foreign Application Priority Data

Nov. 21, 1985 [DE] Fed. Rep. of Germany ..... 3541219

[51] Int. Cl.[4] ..... D01H 5/28; D01H 1/13

[52] U.S. Cl. ..... 57/328; 19/236; 19/246; 19/289; 57/333; 57/350

[58] Field of Search ..... 57/328, 333, 350, 5, 57/6; 19/236, 244, 246, 288, 289

[56] References Cited

U.S. PATENT DOCUMENTS

| | | | |
|---|---|---|---|
| 4,112,658 | 9/1978 | Morihashi | 57/328 |
| 4,124,972 | 11/1978 | Arai et al. | 57/328 |
| 4,387,487 | 6/1983 | Nakahara et al. | 19/249 |
| 4,437,302 | 3/1984 | Anahara et al. | 57/333 |
| 4,445,252 | 5/1984 | Morihashi et al. | 19/244 |
| 4,476,672 | 10/1984 | Anahara et al. | 57/333 |
| 4,497,167 | 2/1985 | Nakahara et al. | 57/328 |
| 4,565,063 | 1/1986 | Stalder et al. | 57/328 |
| 4,593,521 | 6/1986 | Stalder et al. | 57/328 |

FOREIGN PATENT DOCUMENTS

| | | |
|---|---|---|
| 2603511 | 8/1977 | Fed. Rep. of Germany . |
| 3237990 | 8/1983 | Fed. Rep. of Germany . |

*Primary Examiner*—John Petrakes

*Attorney, Agent, or Firm*—Dority & Manning

[57] ABSTRACT

Fiber material to be spun is presented to drafting equipment in the form of a fiber sliver and is subjected to pre-stretching and main stretching in such drafting equipment. While being stretched, the fiber sliver is gathered together to a minimum width which amounts to at least 1.5 times the diameter of a torsion device to be used with the sliver. After being thus gathered together, the fiber sliver is not further gathered together before having torsion imparted thereto while such diameter is maintained. The width of a condenser situated upstream from the main stretching field amounts here to at least 1.5 times the diameter of a pneumatic torsion device situated downstream from such field. The injector component and torsion component of such torsion device are of identical diameter, from their intake opening to their outlet opening. In this way, hairy and soft yarns, similar to ring yarn, are produced.

24 Claims, 5 Drawing Sheets

PROCESS AND DEVICE FOR THE SPINNING OF FIBERS

BACKGROUND AND SUMMARY OF THE INVENTION

The instant invention relates to a process for the spinning of fiber material which is subjected to pre-stretching in a drafting mechanism and to main stretching (i.e., drafting), and which is then spun into a yarn by means of a pneumatic torsion device, as well as to a device to carry out the process.

In a known device the fiber sliver to be spun is stretched to the desired thickness by means of drafting equipment and is then spun into yarn by means of a pneumatic torsion element (DE-OS No. 2,722,319, corresponding with U.S. Pat. No. 4,124,972; and EP-PS No. 0,131,170 corresponding with U.S. Pat. No. 4,565,063.) The yarns spun with such a device are low-bulking and also fail to attain the strength and uniformity of ring yarns. For this reason they are only suitable for a limited range of application.

It is the objective of the instant invention to create a process and a device of the type mentioned above, by means of which high-bulking, soft yarns of a character similar to that of ring yarns can be produced in a simple manner.

This objective is achieved according to the invention in that in the course of stretching, the fiber sliver is gathered together to a minimum width which is at least approximately 1.5 times the diameter of the torsion element, and in that the fiber sliver is not gathered together any further after this first gathering together before being subjected to torsion while said diameter is maintained. It has been shown that controlled spreading of the outer fibers is thus achieved, said fibers looping around the yarn core during the subsequent twisting process so that when the false twist to which the yarn core has been subjected is untwisted these outer fibers are on the one hand incorporated into the yarn core, while on the other hand however, not all of them surround the yarn core with the same density. In this way a hairy and high-bulking yarn with the character of a ring yarn is produced. The fiber sliver is preferably gathered together to its minimum width during pre-stretching, immediately before main stretching. The minimum width should not be more than approximately 2.5 times the diameter of the torsion element. In this way, high spinning speeds can be achieved. It has been shown that the degree to which the fiber sliver is gathered together as it enters the pneumatic torsion element is decisive for the way in which the outer fibers will loop around the yarn core during spinning. In order to maintain control of the relationship required for this, the fiber sliver is gathered together, before entering the pre-stretching phase, only to a width which is greater than the width to which the fiber sliver is gathered together before entering the main stretching phase, in preparation of the entry into the pneumatic torsion element. Gathering the fiber sliver together before it enters the pre-stretching phase to a width which is approximately 1.3 times the width before the main stretching phase has proven to be especially effective. Stretching should be minimal while the fiber sliver is gathered together to the desired minimum width so that this process can be controlled more effectively. To achieve nevertheless a high degree of overall stretching, the pre-stretching phase is divided up, with the first pre-stretching being stronger than the second pre-stretching. Stretching between 1:1.1 and 1:1.5 has been shown to be especially advantageous during the second pre-stretching phase.

The fibers which are spread away from the fiber material leaving the drafting equipment have a tendency to catch, through adhesion, on the normally rubber-coated upper roll of the outlet cylinders of the drafting equipment. It has been shown that these fibers can also easily be fed to the torsion element if the fiber material leaving the drafting equipment has been deflected from its previous conveying plane n direction of the upper roll.

To carry out the described process, a device is used in which the width of the condenser before the main stretching field measures in accordance with the invention at least approximately 1.5 times the diameter of the pneumatic torsion device which has the same diameter in its injector component as well as in its torsion component, from its intake opening to its outlet opening. This configuration makes it possible to build a simple device which furthermore produces the desired, high-bulking yarn, similar to ring yarn. To obtain this spinning result it is also essential that the pneumatic torsion device be at a defined distance from the clamping line of the feeding cylinders of the drafting equipment. The intake opening of the torsion device is therefore located in the nip zone of the pair of feeding cylinders of the drafting equipment. Preferably, the intake opening is located in the tangential plane touching the feeding cylinders.

To incorporate the fibers which are caught due to adhesion on a rubber-coated upper roll of the pair of outlet rolls of the drafting equipment, it is advantageous if the intake opening of the torsion device is offset against the conveying plane of the fiber material in direction of the upper roll.

It has been shown that the strength of the yarn can be influenced favorably by providing notches at the intake into the torsion device, whereby said notches, in a preferred embodiment of the invention, are constituted by the intervals between teeth of an internal toothed ring.

It has been shown that by adapting the angle of inclination of the compressed air channels of the injector component in relation to the axle of the torsion device it is possible to influence the hairiness of the yarn.

According to invention it is therefore possible to provide for this angle of inclination to be increased as the width of the condenser before the main drafting field decreases in size.

To produce soft, hairy yarns it has furthermore proven advantageous if the air pressure in the compressed air channels of the injector component can be controlled in function of the spinning speed, in such a manner that it is lower at higher spinning speeds than at lower spinning speeds.

It has been shown that the best spinning result is achieved when the distance between the compressed air channels of the injector component and the compressed air channels of the torsion component measures from 30 to 40 mm. It is furthermore recommended that the pneumatic torsion element be selected so that the size of the injector nozzle outlet portion defined by the distance between the compressed air channels of the injector component and the clearance between the injector component and the torsion component decreases as the spinning speed drops. In this case the relationship of the lengths of the injector nozzle outlet portion and of the torsion nozzle intake portion is a function of the spinning speed, and is preferably from 1:4 to 3:1.

In order to achieve an optimal effect even when low overpressure is fed to the pneumatic torsion device, the face of said torsion device pointing away from the drafting equipment forms a sharp-edged right angle with the bore of said torsion device in a further embodiment of the invention.

In practice, ring-type yarns are desired which are characterized by their softness to the touch and by their hairy appearance. Such yarns could not be produced until now with spinning devices in which the yarn is produced by means of a pneumatic torsion device. By means of the process and of the device according to the instant invention, this short-coming is eliminated. At the same time the high-bulking character of the yarn can be influenced in many ways without detriment to yarn strength or to economy.

BRIEF DESCRIPTION OF THE DRAWINGS

Examples of embodiments are illustrated in further detail through the drawings, in which.

DETAILED DESCRIPTION OF THE PREFERRED EMBODIMENT

Figure 1:
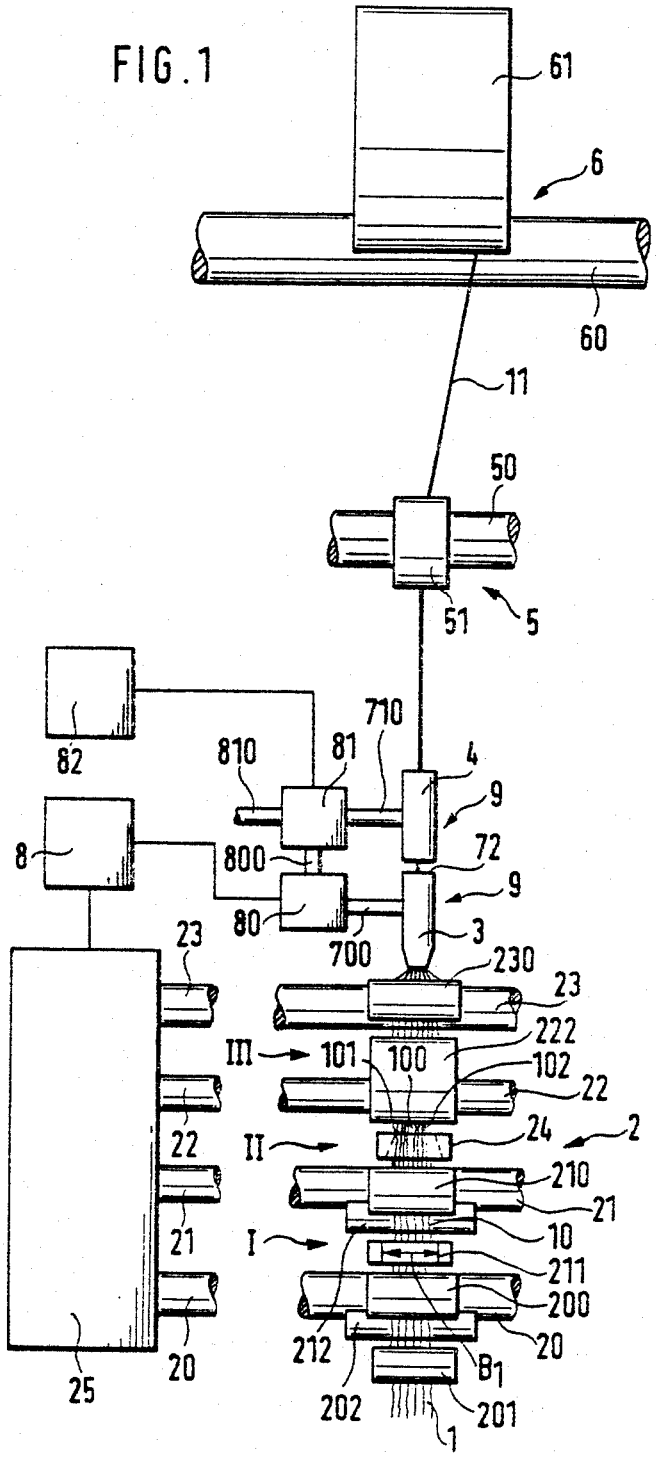
FIG. 1 is a top view of the spinning device according to invention.

The spinning device first described through FIG. 1 has as its most essential elements drafting equipment 2, a pneumatic torsion device 9, a draw-off device 5 and a winding device 6.

Figure 5:
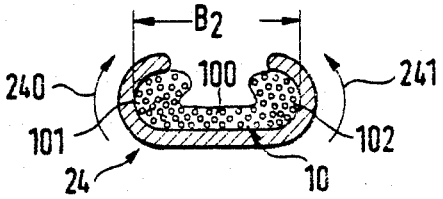
FIG. 5 is a front view of another condenser.
Figure 6:
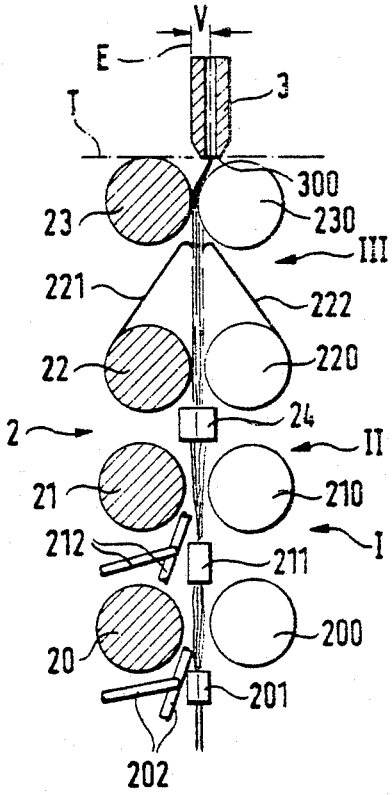
FIG. 6 is a longitudinal section through the drafting equipment according to invention shown in FIG. 1.

According to FIG. 1, the drafting equipment 2 is equipped with four pairs of rolls, consisting of the rolls 20 and 200, 21 and 210, 22 and 220 and of the feeding cylinders 23 and 230, whereby the rolls 22 and 220 are provided with the small belts 221 and 222 respectively at the beginning of the main stretching field III (see also FIG. 6.) In front of the rolls 20 and 200 as well as in front of the rolls 21 and 210 of the pre-stretching fields I and II are located the condensers 201 and 211 respectively, as well as sliver clamping devices 202 and 212 respectively, so that the fiber material can be stopped in front of the rolls 21, 210 in case of yarn breakage. In the pre-stretching field II, between the rolls 21, 210 and 22, 220 is a condenser 24 with a C-shaped cross-section as is shown in FIG. 5 at an enlarged scale.

Figure 2:
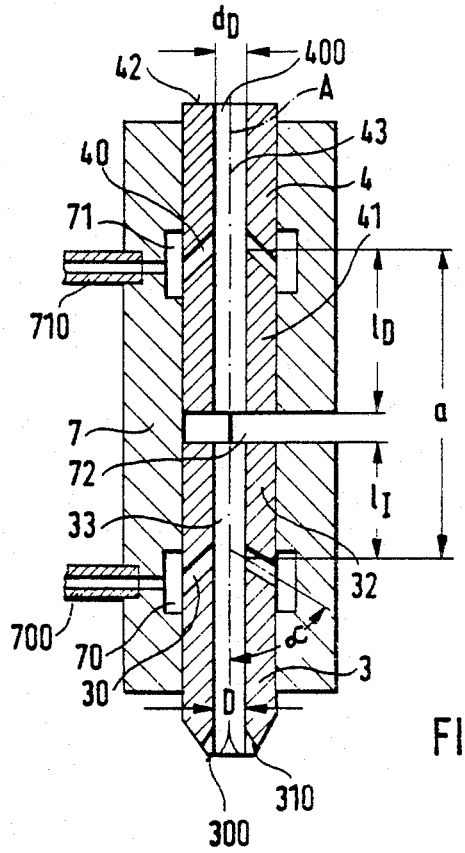
FIG. 2 is a longitudinal section of the torsion device in an embodiment according to invention.
Figure 3:
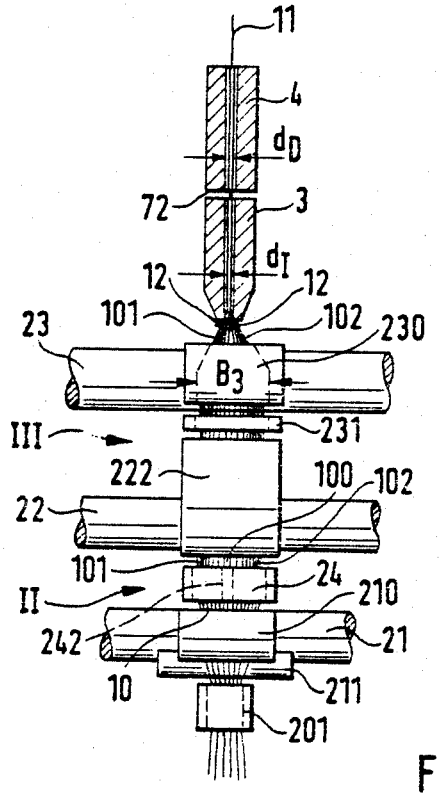
FIG. 3 is a top view of a variant of a portion of the device shown in FIG. 1.

FIGS. 2 and 3 show that the torsion device 9 is equipped with an injector component 3 and a torsion component 4. The injector component 3 as well as the torsion component 4 are provided with the spinning bores 33 and 43 respectively, with cylindrical diameters $d_I$ and $d_D$ of equal size throughout. The injector component 3 and the torsion component 4 are equipped in the known fashion with tangential compressed air channels 30 and 40 slanted in draw-off direction. According to FIG. 2 the injector component 3 and the torsion component 4 are located in a common holding device 7 which is provided with ring channels 70 and 71, of which ring channel 70 is connected to the compressed air channels 30 and ring channel 71 with the compressed air channels 40. The ring channels 70 and 71 are connected via lines 700 and 710 to a source of negative pressure (not shown).

The draw-off device 5, as is shown in FIG. 1, is provided in the usual manner with a driven draw-off roll 50 and with pressure roll which is elastically applied to said draw-off roll 50.

The winding device 6 is equipped with a driven winding roll 60 which drives the bobbin 61, supported in a known manner.

Further means in general use, such as yarn oscillating devices, thread tension compensating bars, yarn monitors etc. are not shown for the sake of simplification.

During the normal spinning process a fiber sliver 1 is fed to the drafting equipment 2. This band-like fiber material, as a result of the pressure which the rolls 200 and 210 exert upon it, is spread out during th stretching process between the rolls 20 and 200 as well as between the rolls 21 and 210. This is also shown schematically in FIG. 8, whereby the clamping line of the rolls 20, 200 is designated $K_{20}$, the clamping line of the rolls 21, 210 is designated $K_{21}$, the clamping line of the rolls 22, 220 is designated $K_{22}$, the clamping line of the feeding cylinders 23, 230 is designated $K_{23}$, and the clamping line of the draw-off device is designated $K_5$.

The fiber sliver 1 is gathered together by the condensers 210 and 211 to a width $B_1$ which is greater than that width $B_2$ to which the fiber material 10 is gathered together in the pre-stretching field II, directly before the main stretching field III. The width $B_1$ and $B_2$ are here selected so that the fiber sliver is gathered together by the condenser 211 to a width $B_1$ that is merely 1.3 times as great as width $B_2$.

When the fiber material 10 being stretched reaches the condenser 24, its width is greater than the clear width W of the condenser 24. The fiber material 10 therefore tends to escape from the condenser 24 in the direction of the pressure exerted toward the center of the band. In doing so, it moves in direction of arrows 240 and 241 alongside the inner wall of the condenser 24 and turns itself over toward the inside, in the manner of a seam. The fiber material 10 is thus given two edge zones 101 and 102 which are thicker in cross section than the center portion 100.

Upon leaving the condenser 24, the fiber material 10 is subjected to the main stretching action in the main stretching field III, between the rolls 22, 220 and the feeding cylinders 23, 230, whereby the fiber material 10 is prevented by the small belts 221 and 222 from spreading out further. The stretched fiber material 10 thus leaves the pair of outlet rolls constituted by the rolls 23, 230 of the drafting equipment 2 with a minimum width $B_3$ (FIG. 3), which is essentially determined by the clear width $B_2$ (see FIGS. 4 and 5) of the condenser 24.

Upon leaving the drafting equipment 2, the fiber material is fed to the intake opening 300 of the torsion device 9. By deflecting the edge zones 101 and 102 of the stretched fiber material 10 between the feeding cylinders 23, 230 of the drafting equipment 2 and the intake opening 300, the ends of the outer fibers are caused to spread away from the band-like fiber material 10. It is these extending fiber ends 12 which gives the yarn 11 its strength later, by becoming incorporated into it, while their position in relation to the finished yarn 11 determines the latter's hairiness.

Figure 8:
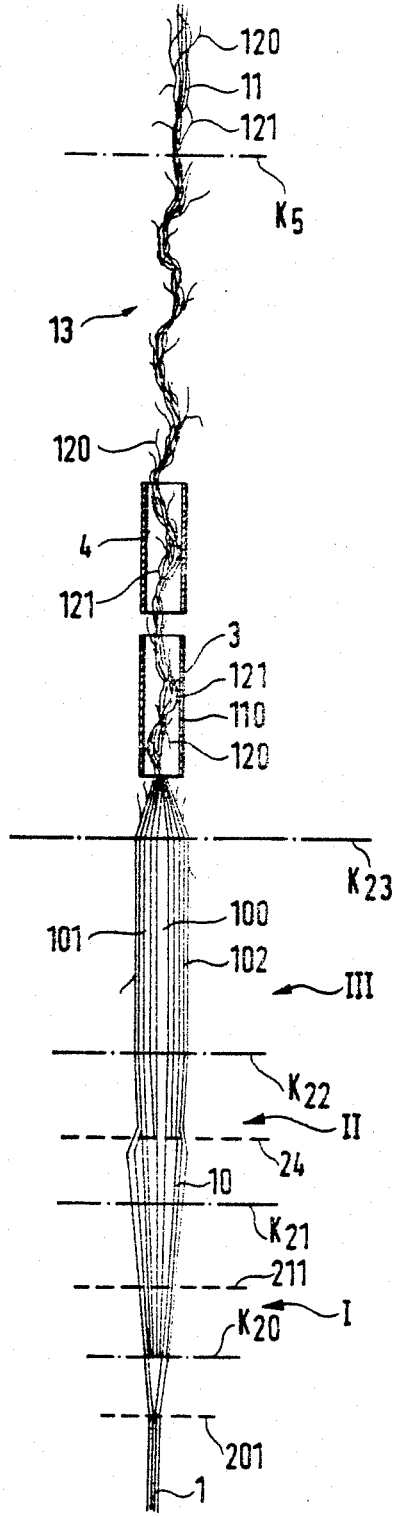
FIG. 8 is a schematic top view of the fiber material, from raw material in form of fiber sliver to the spun yarn.

The pneumatic torsion device 9 imparts a certain amount of false twist to the yarn core 110, and this is again untwisted to a great extent subsequently. As the yarn is given false twist and untwisted again, the fiber ends 12 are incorporated into the yarn core 110 while forming loops 121 and thus give the spun yarn 11 the desired strength (FIG. 8). These loops 121 lie around the yarn core 110 at varying degrees of tightness. This is due to the fact that the twisting takes place in the torsion device 9 while the diameter $d_I = d_D$ is maintained constant, so that the loops 121 are not subjected to any constricting effect, nor to any edge effect, etc. which would otherwise press the fiber ends 12 against the yarn core 110 and would thus cause them to be incorporated tightly. Because of these loops 121 of varying sizes and because of the free fiber ends 120 a high-bulking, hairy yarn 11 which is soft to the touch is produced.

For greater clarity, the balloons 13, the fiber ends 120 and the loops 121 are exaggerated in the schematic drawing of FIG. 8.

In order to give the fiber material sufficient time as it is being gathered together, so that this action can be carried out in a controlled manner, the rolls 22, 220 are driven at less than five times the speed of the rolls 21, 210.

In FIG. 1 the fiber material 10 is furthermore subjected to a further pre-stretching action between the rolls 20, 100 and 21, 210, before reaching the pre-stretching field between the rolls 21, 210 and 22, 220 with condenser 24. Thanks to this double pre-stretching, pre-stretching in the zone of condenser 24 can be further reduced while the main stretching action between the rolls 22, 220 and 23, 230 remains the same. In this instance the first pre-stretching action is set to be less than the second pre-stretching, for which a value between 1:1.1 and 1:1.5 can be selected for example.

The explained process and the described device can have many variations within the framework of the instant invention, for example by replacing certain individual features by equivalents or by using them in different combinations. Thus, for instance, the cross-section of the condenser 24 does not necessarily have to be C-shaped. Depending on the type and strength of the fiber material, the material used for the condenser 24, the height of its passage opening, etc., the condenser 24 can have a cross-section of different forms. It is entirely possible, for example, to use a rectangular cross-section. The outer edges of the band-like fiber material are pushed together in this case too, but are prevented by the stretching tension from escaping up to the center of the band-like fiber material, so that thicker edge zones 101 and 102 are also created, in comparison to the central zone 100. Neither is it necessary for the condenser 24 to be open on its upper side. It is furthermore possible to achieve the uneven distribution of the fiber material in the cross-sectional surface if the condenser 24 is made to subdivide the fiber material 10 being stretched into several interconnected sliver portions. Here too, edge zones 101 and 102 are produced which are thicker than the central zone 100.

Figure 4:
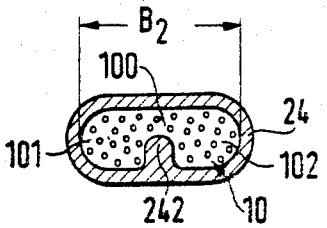
FIG. 4 is a front view of a condenser equipped with a nose, in the pre-stretching field, directly before the main stretching field.

A device to carry out the above-described process is shown in FIGS. 3 and 4. The condenser 24 is equipped with a nose 242 for this purpose, by means of which the fiber material 10 in the process of being stretched is subdivided into two reinforced edge zones 101 and 102 and a thinner central zone 100, however without the contact between the reinforced edge zones 101 and 102 and the central zone 100, and thereby the direct contact between the two edge zones is lost. If desired, the condenser 24 can also be provided with more than one nose 242, so that the fiber material 10 in the process of being stretched is given at least one further, reinforced sliver zone in addition to the reinforced edge zones 101 and 102, said additional reinforced zone being separated from other reinforced sliver zones, e.g. the edge zones 101 and 102 by thinner sliver zones.

As shown in FIG. 3, an additional condenser 231 can be provided in the main stretching field III, i.e. between the small belts 221, 222 and the feeding cylinders 23, 230, in order to ensure the desired minimal width $B_2$ of the fiber material 10.

On the one hand, relatively great deflection of the edge zones 101 and 102 of the fiber material 2 which leaves the drafting equipment 2 on its way to the injector nozzle 3 is desirable so that as many fiber ends 12 as possible are spread out. On the other hand, too wide a feeding of the fiber material leads to difficulties at the entry into the injector nozzle 3. A minimum width $B_3$ of the fiber material 10 leaving the drafting equipment 2, said width not being less than 1.5 times and not being more than 2.5 times the inside diameter $d_I$ of the injector component 3 (and thereby also the inside diameter $d_D$ of the torsion element 4, of same size) of the torsion device 9, has proven to be a good solution, ensuring the spreading of a sufficient number of fiber ends 12 without endangering spinning security. For this reason the clear width of the condenser 231, as does that of the condenser 24, amounts to 2.5 the inside diameter $d_I$. The fiber material 10 is thus gathered up to the minimum width $B_3$ within the pre-stretching field II, immediately preceding the main stretching field III.

To obtain not only sufficient spreading of fiber ends 12, but to ensure, furthermore, that the produced yarn 11 is of sufficient strength, it has been shown that an inside diameter $d_I = d_D$ between 2.3 and 2.8 mm for the spinning bores 33 and 43 is especially indicated, with the best results being obtained with a diameter $D = d_I = d_D$.

As a comparison between FIGS. 1 and 3 shows, it is not absolutely necessary for four pairs of rolls 20 and 200, 21 and 210, 22 and 220 as well as 23 and 230 to be installed in a row in order carry out the process but, depending upon the type of raw material used it may be sufficient to use only three such pairs 21 and 210, 22 and 220 as well as 23 and 230. Drafting equipment units 2 with more than three pairs of rolls are however especially suitable if a thick fiber sliver 1 is fed to the drafting equipment 2 or if more than one fiber sliver 1 is being fed to the drafting equipment 2. Depending upon the fiber material, the spinning speed etc., it may also be possible to dispense with the small belts 221, 222.

It has been shown that the fibers often catch through adhesion on the rolls 230 when the normally rubber-coated lift-off rolls 230 (upper rolls) of the outlet pair of rolls of the drafting equipment 2 are used. This leads to undesirable fiber losses. To avoid this, provisions are made according to FIG. 6 for the fiber material 10 leaving the drafting equipment 2 in direction of the feeding cylinder 230 to be deflected out of its former conveying plane E which is defined by the clamping lines of the rolls (20 and 200), 21 and 210, 22 and 220 as well as 23 and 230. For this purpose, as shown in FIG. 3, the injector component 3 is offset with its intake opening 300 in direction of the feeding cylinder 230 (upper roll) against the conveying plane E of the fiber material 10, whereby an offset V of over 1 mm has proven to be best.

The measure consisting in locating the intake opening 300 of the torsion device 9 within the nip zone of the feeding cylinders 23, 230 of the drafting equipment 2 serves that same purpose as well as that of spreading away a great number of free fiber ends 101. According to FIG. 6 this arrangement consists in locating the intake opening 300 of the torsion device 9 essentially in the tangential plane T which touches the feeding cylinders 23, 230.

It has further been shown that an even propagation of the twist from the torsion device 9 in direction of the drafting equipment 2 affects yarn strength. According to FIGS. 2 and 3, several notches 310 are provided at the intake opening 300 of the injector component 3 to influence the propagation of twist from the torsion device 9 to the drafting equipment 2. By means of these notches 310, the twist is propagated unevenly on the periphery of the intake opening 300 in direction of the drafting equipment 2.

Figure 7:
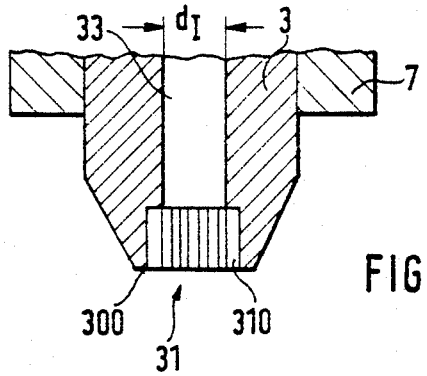
FIG. 7 is a longitudinal section through the intake opening of a torsion device according to the invention.

The notches 310 can be made in different ways. According to FIG. 7 the notches 310 are constituted by the intervals between teeth of an internal toothed ring. In that instance the inside diameter of the internal toothed ring is also equal to the internal diameter $d_I$ of the injector element 3, so that a constant internal diameter $D_I$ of the torsion device 9 is also present in this case.

The compressed air channels 30 in the injector element 3 are inclined at an angle $\alpha$ of inclination which is normally used (usually between 30° and 60°) with respect to the axis A of the injector element 3. However, it has been shown that by adapting the angle of inclination $\alpha$ between the compressed air channels 30 and the axis A to the width $B_3$ of the fiber material 10 leaving the drafting equipment 2, the spinning results can be improved with respect to hairiness and strength. In this case a smaller angle of inclination $\alpha$ should be selected for a greater width $B_3$ and a greater angle of inclination a for a smaller width $B_3$. Since the width $B_3$ is determined by the width $B_2$ selected for the condenser 24 preceding the main stretching field III, this adaptation of the angle of inclination $\alpha$ can be achieved by changing the injector component 3.

Not only the angle of inclination $\alpha$ of the compressed air channels to the axis A, but also the air pressure to which the injector component 3 is subjected play an important role in the obtention of good spinning results. This air pressure is generally in the range of 3 to 6 bar. As the spinning speed increases, spinning tension in the yarn 11 being produced increases correspondingly. This also causes the friction of the fiber material entering the injector component 3 to increase. To compensate for this, lower overpressure in the compressed air channels 30 is therefore selected for the injector component 3 at higher spinning speeds than at lower spinning speeds. For this reason a choker valve 80 is provided for the injector component 3, as shown in FIG. 1, whereby said choker valve 80 is controllably connected to a control device 8 which controls the drive 25 for the rolls 20, 21, 22 and 23, and thus controls their speed. In addition, the compressed air channels 30 are connected via choker valve 80 and a line 800, and the torsion component 4 is linked via line 710 to a check valve 81 which is opened and closed by another control device 82 and thus switches the overpressure in a supply line 810 to which said check valve 81 is connected on or off in the compressed air channels 30 and 40.

The produced yarn 11 should not only be hairy and high-bulking, but should furthermore be produced economically. It has been shown that by maintaining certain dimensions and relationships, air consumption can be kept especially low while the yarn produced remains of the best quality.

A distance a of 30 to 40 mm between the compressed air channels 30 and 40 has proven to be especially well-suited for spinning.

If the segment of the injector component 3 which lies between the compressed air channels 30 and the interval 72 between the injector component 3 and the torsion component 4 is designated outlet portion (32) of the injector component, having a length $1_I$, and if the segment of the torsion nozzle 4 between the compressed air channels 40 and the above-mentioned interval 72 is designated intake portion 41 of the torsion component, having a length $1_D$, the relationship $1_I$:$1_D$ should be between 1:4 and 3:1. It has been shown that at lower spinning speeds the outlet portion (32) of the injector component should be smaller than the torsion component intake 41, while at higher spinning speeds the intake portion 41 of the torsion component should be smaller than the outlet portion (32) of the injector component. At median spinning speeds the outlet portion 32 of the injector component and the intake portion 41 of the torsion component should therefore be of the same size. The adaptation to the spinning speeds is effected through replacement of the injector component 3 and/or the torsion component 4, or through replacement of the entire torsion element 9. It has thus been shown that at a yarn draw-off speed of 130 m/min, a ratio of $1_I$:$1_D$ of 1:2 is especially well-suited, with this ratio $1_I$:$1_D$ becoming 2:1 at speeds of 140 m/min and over.

In order to obtain the best possible injector effect of the torsion nozzle 3 it has been shown to be especially advantageous if the face 42 of the torsion component 4 pointing away from the drafting equipment 2 forms a sharp-edged right angle with the spinning bore 43. In this way the desired torsion effect can already be achieved with relatively low air overpressure.

Although different possibilities have been mentioned above to obtain optimal results through appropriate selection of the injector component 3, of the torsion component 4 or of the entire pneumatic torsion device 9, good yarn results are also obtained when appropriate average values are selected for the dimensions mentioned, whereby it is entirely sufficient, for the production of yarns in certain thicknesses and made of certain materials to simply control the rotational speed of the roller pairs of the drafting equipment 2 and the overpressure to which the torsion device is subjected.

To further explain the invention, two embodiments are described below and their values are given:

(a) 4-cylinder drafting equipment as shown in FIGS. 1 and 6:

Peripheral speed, roll 20: approx. 1.2 m/min
Peripheral speed, roll 21: 4.8 m/min
Peripheral speed, roll 22: 6 m/min
Peripheral speed, feeding cylinder 23: 150 m/min
Stretching in pre-stretching field I: 1:4.224
Stretching in pre-stretching field II: 1:1.25
Stretching in main stretching field III: 1:25
Total stretching: 1:132

Width $B_1$: 7 mm
Width $B_2$: 5 mm
Injector component 3:
2 tangential compressed air channels 30
Inclination $\alpha=40°$
Torsion component 4:
3 tangential compressed air channels 40
Inclination $\alpha=55°$
Diameter D: 2.5 mm
Overpressure in compressed air channels 30: 3.5 bar
Overpressure in compressed air channels 40: 4 bar
Material: 65/35 polyester/cotton mixture
Sliver weight: 3.3 g/m=3.3 ktex
Yarn: Nm 40

(b) 3-cylinder drafting equipment as shown in FIG. 3:
Peripheral speed, roll 21: approx. 0.9 m/min
Peripheral speed, roll 22: approximately 5.3 m/min
Peripheral speed, feeding cylinder 23: 160 m/min
Stretching in pre-stretching field II: 1:1.583
Stretching in main stretching field III: 1:30
Total Stretching: 1:175
Width $B_2$: 5 mm
Injector components 3:
2 tangential compressed air channels 30
Inclination $\alpha=40°$
Torsion component 4:
3 tangential compressed air channels 40
Inclination $\alpha=55°$
Diameter D: 2.5 mm
Overpressure in compressed air channels 30: 3 bar
Overpressure in compressed air channels 40: 4 bar
Material: Cotton 3.5 g/m=3.5 ktex
Yarn: Nm 50

We claim: –

1. Process for the spinning of a fiber sliver, including subjecting the silver to pre-drafting and to subsequent main drafting in drafting equipment, and the spinning same into a yarn in a pneumatic torsion device having respective intake and outlet openings for receiving such sliver and outputting such yarn, respectively, with a yarn passageway of predetermined diameter defined between such openings, wherein during the drafting process prior to main drafting the fiber sliver is controllably spread to a minimum width which is at least 1.5 times, but no more than about 2.5 times, the diameter of the torsion device yarn passageway, and further wherein the fiber sliver width is generally not subjected to any further width changes before entering said torsion device, whereupon torsion is imparted thereon, and wherein the torsion device yarn passageway diameter is maintained substantially constant between said intake and outlet openings thereof.

2. Process as in claim 1, characterized in that said controllable spreading to said minimal width occurs during said pre-drafting, immediately before said main drafting.

3. Process as in claim 1, characterized in that the fiber sliver is controllably spread to a greater width before entering said pre-drafting, during which said spreading to said minimum width occurs.

4. Process as in claim 3, characterized in that the fiber sliver is spread to said greater width, which is approximately 1.3 times said minimum width, before main drafting.

5. Process as in claim 1, characterized in that the fiber sliver is pre-drafted twice.

6. Process as in claim 5, characterized in that the first pre-drafting effect is greater than the second pre-drafting effect.

7. Process as in claim 6, charaterized in that the second pre-drafting effect lies between 1:1.1 and 1:1.5.

8. Process as in claim 1, characterized in that the fiber sliver leaving the drafting equipment is deflected from its former conveying plane.

9. Device to spin a fiber sliver comprising:
drafting equipment providing a pre-drafting field and a main drafting field;
a condenser situated before said main drafting field, and generally having a predetermined inside diameter which establishes the general width of a fiber sliver passing therethrough; and
a pneumatic torsion device immediately following said drafting equipment, said torsion device including an injector component and a torsion component, an intake opening generally facing towards said drafting equipment to receive fiber sliver therefrom, an outlet opening generally opposite said intake opening for outputting yarn, and having a constant inside diameter yarn passageway throughout said injector component and said torsion component from its intake opening to its outlet opening; and
wherein said condenser situated before said main stretching field has an inside diameter at least approximately 1.5 times that of said torsion device yarn passageway diameter, but no more than about 2.5 times that of said torsion device yarn passageway diameter, and wherein the width of fiber sliver so established is generally maintained throughout said main drafting field until entering said torsion device.

10. Device as in claim 9, characterized in that said intake opening of said torsion device is located in a nip zone of feeding cylinders of said drafting equipment.

11. Device as in claim 10, characterized in that said intake opening of said torsion device is located nearly within a tangential plane touching said feeding cylinders.

12. Device as in claim 9, characterized in that said intake opening of said torsion element is offset in the direction of an upper roll of drafting equipment feeding cylinders with respect to a conveying plane of the fiber material.

13. Device as in claim 9, characterized in that notches are provided at said intake opening of said torsion device.

14. Device as in claim 13, characterized in that said notches are constituted by intervals between adjacent teeth of an integral toothed ring situated in said intake opening.

15. Device as in claim 9, further comprising a compressed air channel for said injector component, said channel having an angle of inclination relative the axis of said torsion device which increases as the width of said condenser situated before said main stretching field decreases.

16. Device as in claim 15, characterized in that the air pressure fed into said compressed air channel of said injector component is lower at higher spinning speeds than at lower spinning speeds.

17. Device as in claim 9, characterized in that said diameter of said torsion device yarn passage lies between 2.3 and 2.8 mm, and is prefereably about 2.5 mm.

18. Device as in claim 9, further comprising respective compressed air channels for said injector component and said torsion component, the distance between such respective air channels measuring about 30 to 40 mm.

19. Device as in claim 9, further comprising:

respective compressed air channels for said injector and torsion components; and an interval between said injector component and torsion component which is open to the atmosphere;

wherein an outlet portion of said injector component defined by the distance between said compressed air channel of the injector component and said interval decreases in size by comparison with an intake portion of said torsion component defined by the distance between said compressed air channel of said torsion component and said interval as spinning speed decreases.

20. Device as in claim 19, characterized in that the ratio between the lengths of said outlet portion of said injector component and said intake portion of said torsion component range from 1:4 to 3:1 as a function of spinning speed.

21. Device as in claim 9, wherein said torsion device includes a face thereof pointing away from said drafting equipment, said face forming a sharp-edged right angle with a bore of said torsion device.

22. A method of spinning fiber sliver into yarn, said method including:

providing a pneumatic torsion device having respective inlet and outlet opening, and a yarn passageway between such openings having a substantially constant inside diameter;

feeding a fiber sliver to the torsion device, first through a pre-drafting field, and then through a main drafting field;

controllably spreading such fiber sliver, generally prior to entry thereof into said main drafting field, by generally establishing the width of such fiber sliver generally in a range of from about 1.5 times to about 2.5 times the torsion device yarn passageway inside diameter, while generating relatively reinforced sliver edge zones and a relatively thinner sliver central zone; and generally maintaining such established sliver width and relative reinforced edge zones and thinner central zone, as such sliver passes through the main drafting field until right as such sliver enters the torsion device;

whereby the controllably spread outer fiber sliver edge zones are looped around the silver central zone during twisting with the torsion device, so that a relatively hairy and highbulking yarn is produced.

23. A method as in claim 22, wherein sad torsion device includes an injector component followed by a torsion component, with air pressure in compressed air channels of the injector component being controlled as a function of spinning speed, so that such air pressure is generally lower at higher spinning speeds than at lower spinning speeds.

24. A method as in claim 22, wherein said fiber sliver edge zones are deflected between said main drafting field and said pneumatic torsion device so that the fiber ends of such fiber sliver edge zones are caused to spread away from said fiber sliver for subsequently becoming incorporated into yarn produced with said torsion device.

* * * * *